United States Patent [19]

Tyroler

[11] 4,302,068

[45] Nov. 24, 1981

[54] INFRARED REFLEX DEVICE

[75] Inventor: Jesse F. Tyroler, Randolph, N.J.

[73] Assignee: The United States of America as represented by the Secretary of the Army, Washington, D.C.

[21] Appl. No.: 133,033

[22] Filed: Mar. 24, 1980

[51] Int. Cl.[3] ..... G02B 5/22

[52] U.S. Cl. ..... 350/1.1; 428/919

[58] Field of Search ..... 114/15; 428/919; 427/81; 89/36 R; 244/3.16; 250/342; 350/1.6, 292, 307, 1.1

[56] References Cited

U.S. PATENT DOCUMENTS

| | | | |
|---|---|---|---|
| 3,468,218 | 9/1969 | Schinnelpfennig | 350/307 |
| 3,469,898 | 9/1969 | Altman | 350/103 |
| 3,671,110 | 6/1972 | Wassenhave | 350/307 |
| 4,089,491 | 5/1978 | Ferris | 89/36 R |
| 4,142,015 | 2/1979 | Bienz | 428/919 |

FOREIGN PATENT DOCUMENTS

| | | | |
|---|---|---|---|
| 565238 | 11/1944 | United Kingdom | 428/919 |
| 566921 | 1/1945 | United Kingdom | 428/919 |
| 2001417 | 7/1977 | United Kingdom | 114/15 |

OTHER PUBLICATIONS

Lafferman, "Paints and Coating Technology . . . ", 2/79, pp. 12–13, Army Research & Development & Acquisition Mag.

"Camouflage is a Design Problem Requiring Imagination Plus Skill", Product Engineering, 1/43.

*Primary Examiner*—Nelson Moskowitz

*Attorney, Agent, or Firm*—Nathan Edelberg; Robert P. Gibson; Max Yarmovsky

[57] ABSTRACT

An infrared reflex device can simulate an infrared image. The device has a latticed panel which has a first and second plurality of exposed elements. The first plurality of elements has over a predetermined infrared spectrum a spectral emissivity substantially less than soil. This first plurality is also a reflector of infrared radiation. The second plurality has greater spectral emissivity and less reflectivity than the first plurality over the predetermined infrared spectrum.

11 Claims, 7 Drawing Figures

FIG. 1
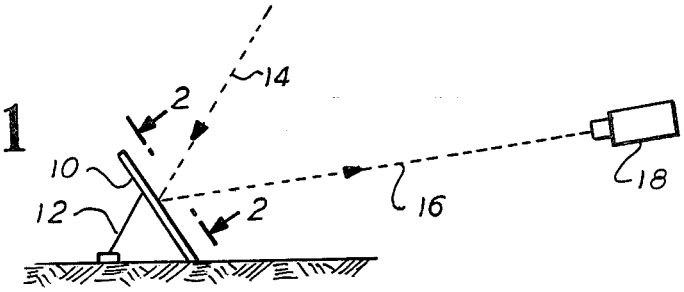
FIG. 2
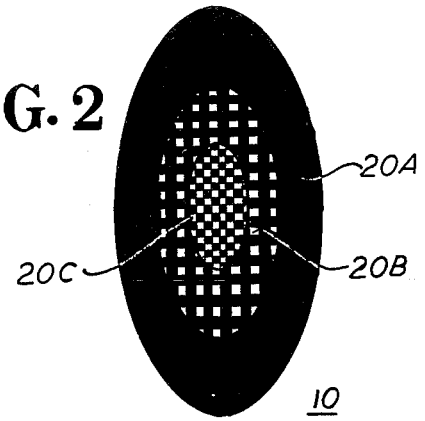
FIG. 3
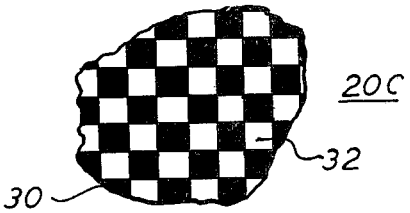
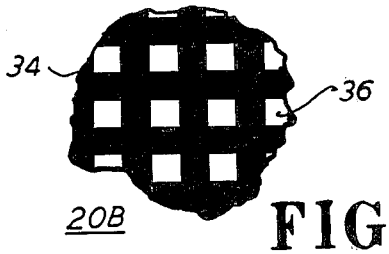
FIG. 4
FIG. 5
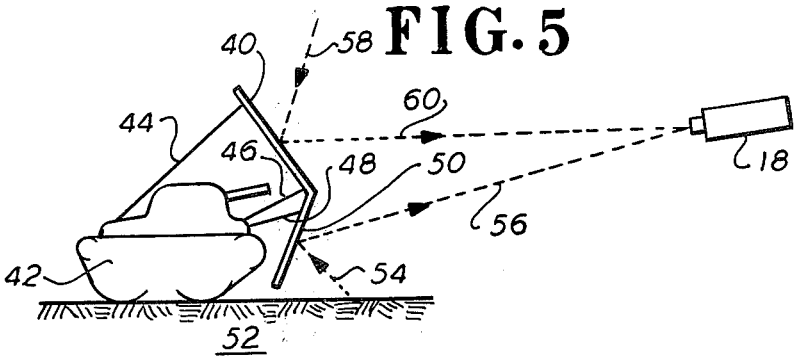
FIG. 6
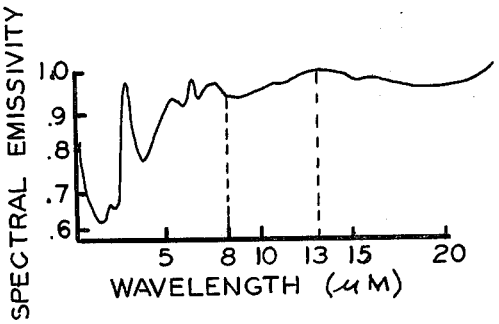
FIG. 7
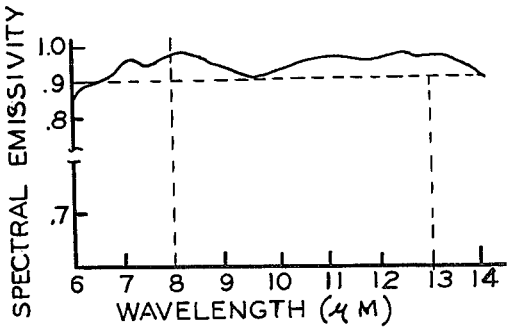

INFRARED REFLEX DEVICE

GOVERNMENT INTEREST

The invention described herein may be manufactured, used and licensed by or for the government for governmental purposes without the payment to me of any royalties thereon.

BACKGROUND OF THE INVENTION

The present invention relates to reflex devices and in particular to devices for simulating an infrared image.

Far Infrared Imaging Devices, many of which operate in the 8 to 13 micron spectral region (a region of high transmission through the atmosphere) rely on small temperature differences between the object being viewed and the background as well as any temperature gradations within the object in order to both recognize and determine features within the object itself. These imaging devices are sensitive to the infrared emission associated with the temperature of the object rather than the reflected light as in the case with visible radiation.

For example, a vehicle can appear as an object that is either hotter or colder than the surrounding terrain. The reason is that the thermal heating and cooling rates of a large steel mass are very different from thermal heating or cooling of the terrain. Whether it is hotter or colder will depend on the history of the air temperature, the amount of sunlight, if daytime, and the recent use of the vehicle. Under either condition the vehicle is just as easily identifiable to an infrared imaging device since it is only dependent on the extent of the temperature differences rather than whether it is colder or hotter than the surrounding terrain.

It has been known to provide a decoy or training device which is heated. This heated decoy is necessarily complex and requires an independent energy source. These known decoys do not have provisions for shaping the temperature gradation over its surface to simulate a given target.

Accordingly, there is a need for a simple passive device for simulating an infrared image which does not require an independent heating source or other elaborate apparatus.

SUMMARY OF THE INVENTION

In accordance with the illustrative embodiments demonstrating features and advantages of the present invention there is provided an infrared reflex device for simulating infrared images. This device includes a latticed panel having a first and second plurality of exposed elements. The first plurality of elements has over a predetermined infrared spectrum a very low spectral emissivity. This first plurality also is a good reflector of infrared radiation. The second plurality has a much greater spectral emissivity and very little reflectivity as compared to the first plurality over the predetermined infrared spectrum.

By employing such apparatus a relatively simple device can effectively simulate a complex infrared image. For example, a reflex device can be constructed with a plurality of metal elements set at an angle to reflect downrange the infrared radiation descending from the night sky. The apparent temperature of the night sky is normally 30° to 50° C. colder than the terrain. Since the metalic surface has a low emissivity, very little radiation would be emitted from it due to its ambient temperature. Accordingly, by using a tilted reflective panel a large apparent temperature variation can be simulated. However, this temperature variation can be moderated by interleaving these metal elements with elements that have less reflectivity but greater spectral emissivity. In one embodiment, such a latticed panel is formed by painting a checkerboard pattern over an aluminum panel. Consequently, the painted portions emit radiation corresponding to its temperature, normally the ambient temperature. As a result the average temperature of the latticed panel will appear somewhat greater than the effective temperature of the sky. For example, if 50% of the latticed panel is reflective and the effective temperature of the sky is 40° C. lower than the surrounding terrain, the effective temperature of the lattice will be about 20° C. lower than the surrounding terrain. It is preferred that the lattice pattern be sufficiently fine, that the imaging device observing the pattern cannot resolve its detailed structure. Accordingly, the imaging device will observe one or a limited number of uniform surfaces of constant temperature. It is preferred that the panel be shaped approximately in the form of the object which is to be simulated. Furthermore, the lattice is preferably partitioned into various zones of constant temperature. However, the temperature gradations from zone to zone will vary to simulate the expected temperature gradation over the object which is being simulated.

According to one embodiment of the present invention, the latticed panel may be mounted above a vehicle to draw gun fire to the elevated panel so that ammunition is fired above the vehicle. In this embodiment it is preferred that the panel have depending below it an infrared reflector plate which is angled to reflect downrange infrared energy emanating from the soil of the surrounding terrain. This plate will then effectively screen or hide the vehicle and appear to be identical to the surrounding terrain.

It is anticipated that apparatus according to the invention can be relatively simple and reliable and in its simplest form can be an aluminum foil painted with a checkerboard pattern.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings wherein:

FIG. 1 is an elevational view of an infrared reflex device according to the present invention;

FIG. 2 is a view of the panel of FIG. 1 along lines 2—2 thereof;

FIG. 3 is a detailed view of a fragmentary portion of the panel of FIG. 2;

FIG. 4 is a detailed view of a fragmentary portion of the panel of FIG. 2;

FIG. 5 shows an alternate embodiment wherein a panel according to the present invention is installed on a tank;

FIG. 6 is a graphical representation of the spectral emissivity of soil with respect to wavelength; and FIG. 7 is a graphical representation of the spectral emissivity of a common paint with respect to wavelength.

DETAILED DESCRIPTION OF THE PREFERRED EMBODIMENTS

Referring to FIG. 1, a reflex device is shown as latticed panel 10 located to ground level. Panel 10 is shown tiltedly set by a mounting means, illustrated herein as strut 12. This strut sets the latticed panel 10 at an angle to reflect radiation descending from the sky (path 14) downrange along path 16 to an infrared imaging device 18. It is to be appreciated that the specific angle at which latticed panel 10 is set is not critical since it is reflecting the diffuse radiation throughout the sky and not the incident radiation from the sun. Indeed, it is expected that latticed panel 10 will be used primarily at night. In one embodiment the latticed panel was set at approximately 45° with respect to vertical.

Referring to FIG. 2, it shows a normal view of panel 10, along lines 2—2 of FIG. 1. It will be appreciated that this panel is an exemplary example and as further explained hereinafter many variations are contemplated. The perimeter of latticed panel 10 is essentially elliptical. Accordingly, when tilted, it appears essentially circular. The surface of latticed panel 10 is partitioned into three concentric elliptical zones; outer zone 20A; middle zone 20B; and center zone 20C. Outer zone 20A is an aluminum foil substrate completely covered with paint which has a high emisivity in the spectral region of interest. Thus, its temperature appears to an infrared imaging device as being essentially the temperature of the paint, normally the ambient. FIG. 7 shows an example of the spectral emissivity of a paint in the region of prime interest. Middle zone 20B is an aluminum foil substrate partially covered by a checkerboard pattern of paint, as illustrated in further detail hereinafter. Similarly, zone 20C is an aluminum foil substrate convered also with a checkerboard paint pattern but one covering a different percentage of the aluminum foil.

It is to be appreciated that the specific perimeter and zone partitioning of FIG. 2 is merely exemplary. It is anticipated that for other embodiments the perimeter of latticed panel 10 will be modified to simulate the appearance of other objects. For example, the perimeter of the latticed panel can be dimensioned to simulate a tank in both height and width. It will be appreciated that the vertical dimensions are to be adjusted to correct for the fact that the latticed panel is typically tilted. Furthermore, the partitioning of the lattice zones need not be a simple concentric elliptical arrangement. The partitioning of the lattice zones can be set to simulate the temperature gradations normally occurring in a target such as a tank or other object.

Referring to FIG. 3, a detailed view of a fragment of the latticed panel in zone 20C (FIG. 2) is illustrated. It will be observed that the latticed panel is comprised of a first plurality of elements shown herein as a lattice mask 30 which is in the form of an open checkerboard pattern of paint. This paint overlies reflective aluminum foil substrate 32 to provide from it a second plurality of elements. This paint has a much higher emissivity and lower reflectivity than the aluminum foil. The foil may be mounted on any convenient surface. It is to be appreciated that latticed panel 20C can be fabricated in various manners. For example, instead of foil, a metal plate of low emissivity and high reflectivity may be employed. Also, instead of the foregoing masked substrates, an inlaid structure may be employed. As an alternative, latticed panel 20C can be fabricated as a non-reflective substrate overlayed with a plurality of metal foil elements. This situation would correspond to reversing the sense of reflective elements 32 and non-reflective elements 30. Furthermore, it is to be appreciated that the paint or other high emissivity material lattice 30 need not be a checkerboard. For example, a plurality of parallel bars, a matrix of dots or other geometric figures may be employed instead. In addition, rectilinear figures are unnecessary and the pattern can be formed of various curvilinear figures.

Referring to FIG. 4 a fragment of zone 20B of the latticed panel is illustrated in detail. As shown herein a grid of interlaced stripes of paint 34 overlays a reflective aluminum foil substrate 36. It is to be appreciated that interlaced stripes 34 are a plurality of elements having contiguous boundaries. It is also to be noted that the percentage of substrate 36 which is overlayed by stripes 34 is greater than that previously illustrated in connection with FIG. 3. Specifically, stripes 34 overlay 75% of the substrate 36 as opposed to 50% in FIG. 3.

In summary, the zones 20A, 20B and 20C of FIG. 2 are zones over which the painted lattice covers 100, 75 and 50%, respectively, of the underlying substrate. Accordingly, if the latticed panel 10 of FIGS. 1 and 2 is set to reflect the infrared radiation of the night sky downrange along line 16 each zone will appear different at imager 18. The radiant flux per unit area R in units of watts/meter$^2$ from each homogeneous element of latticed panel 10 can be calculated according to the following expression:

$$R = \int_{\lambda_1}^{\lambda_2} \frac{E\,C_1\,d\lambda}{\lambda^5(e^{C_2/\lambda T} - 1)}$$

wherein T is the absolute temperature in degrees Kelvin, $\lambda$ is wavelength in microns and $C_1$ and $C_2$ are constants having the values of $3.74\times10^8$ and $1.43\times10^4$, respectively. The variable $\lambda$ is integrated over the utilized values of wavelength $\lambda_1$ to $\lambda_2$. For many applications the quantities $\lambda_1$ and $\lambda_2$ (which are the wavelengths over which the infrared imaging device operates) are 8 and 13 microns, respectively. The quantity E is the emissivity of the observed object and in general can be a variable with respect to wavelength. As an example, the emissivity of soil is illustrated in FIG. 6 where it may be observed that its value is close to unity over the wavelengths of interest (8 to 13 microns). Furthermore, for the wavelengths of interest many paints have emissivity which is near unity (FIG. 7). In contrast, the emissivity of a metal such as aluminum is relatively low and is less than 0.03 for the wavelengths of interest (8 to 13 microns). Accordingly, in comparison to the painted elements 30 and 34 (FIGS. 3 and 4), the aluminum foil substrate contributes relatively little original thermal radiation since its emissivity E is very low. However, these metal foil elements do reflect incident radiation so that they appear to have about the temperature of the environment reflecting from it.

It is also significant to note that an imaging device such as device 18 (FIG. 1) has a limited resolving power typically in the order of 1 milliradian. An an example, it cannot resolve any detail within 0.1 meters at a distance of 100 meters. Thus, if the patterns of FIGS. 3 and 4 repeat every 0.1 meters then the average radiant flux perceived by device 18 at a distance of 100 meters will be the same across each zone of latticed panel 10 (FIGS. 1, 2, 3 and 4). Accordingly, the temperature over each zone will appear to be constant. Of course, if the imaging device 18 is to be operated closer to latticed panel 10 then the patterns of FIGS. 3 and 4 must be finer so that its fine structure is not perceptible. Also, while convenient, it is unnecessary for the patterns of FIGS. 3 and 4 to be periodic. It is preferable, however, that the average radiation throughout each zone be constant when measured over an area element equivalent to the resolution of the imaging device 18.

Referring to FIG. 5, an alternate latticed panel 40 is illustrated. In this embodiment latticed panel 40, which is similar to the previously illustrated latticed panel, is shown installed on a vehicle, in this embodiment, tank 42. Means for mounting the panel on the vehicle is shown herein as struts 44, 46 and 48. Depending from latticed panel 40 and tilted in an opposite direction thereto is infrared reflective plate 50. Plate 50 is in this embodiment a continuous sheet of aluminum foil overlaying a supporting backer. Being oriented as illustrated, plate 50 reflects downrange radiation emanating from soil 52. The path of this radiation is illustrated by rays 54 and 56. Infrared radiation descending from the sky is shown reflected from latticed panel 40 along rays 58 and 60. Rays 60 and 56 are shown converging into an infrared imaging device 18. Since plate 50 reflects the radiation emanating from the soil, the plate appears indistinguishable to imager 18 from the surrounding terrain. Accordingly, tank 42 is masked or hidden by plate 50. However, latticed panel 40 is arranged to have a perimeter similar to that of tank 42 and also to have an arrangement of zones which simulate the temperature gradations of the tank. Accordingly, the tank 42 will appear at a higher elevation and/or a greater range than it actually is. Consequently, a weapon aimed at panel 40 will overshoot tank 42.

It is to be appreciated that various modifications may be implemented with respect to the above described preferred embodiments. For example, various materials may be substituted to provide the desired emissivity and reflectivity. In addition, the latticed panel may be shaped into a hemispherical, semi-cylindrical, polyhedronal or other convenient shape depending upon the particular application.

Furthermore, the dimensions of lattice patterns may be altered depending upon the expected range over which the device is to operate. It is also to be understood that the device can be moving or stationary and can be used either as a practice target or a decoy.

Obviously, many other modifications and variations of the present invention are possible in light of the above teachings. It is therefore to be understood that within the scope of the appended claims, the invention may be practiced otherwise than as previously described.

I claim:

1. An infrared reflex device for stimulating infrared images comprising:

a latticed panel having a first and second plurality of exposed elements, said first plurality of elements having over a predetermined infrared spectrum a spectral emissivity substantially less than soil, said first plurality being a reflector of infrared radiation, said second plurality having a greater spectral emissivity and lesser reflectivity than said first plurality over said predetermined infrared spectrum said second plurality includes:

an open pattern whereby an instrument having resolution insufficient to distinguish the details of said pattern would perceive it as a uniform surface.

2. An infrared reflex device according to claim 1 further comprising:

mounting means for tiltedly setting said panel.

3. An infrared reflex device according to claim 2 wherein said panel is canted upwardly to reflect downrange infrared radiation descending from the sky.

4. An infrared reflex device according to claim 1 wherein said first plurality comprises a reflective substrate and said second plurality comprises a mask overlaying said substrate.

5. An infrared reflex device according to claim 1 further comprising:

an infrared reflective plate mounted below and tilted in a direction opposite to said panel, said panel and plate being arranged to reflect downrange light from the sky and earth, respectively.

6. An infrared reflex device according to claim 5 further comprising:

means for mounting said panel and plate on a vehicle.

7. An infrared reflex device according to claim 1 wherein said device is operable to simulate an infrared image of a given vehicle and wherein said panel is sized and set to appear as high and as wide as said vehicle.

8. An infrared reflex device according to claim 1 wherein said second plurality has an open pattern which is partitioned into at least two zones, each of said two zones being open a different percentage over its respective area.

9. An infrared reflex device according to claim 8 wherein said device is operable to simulate an infrared image of a given object and wherein said pattern is partitioned along boundaries equivalent to equithermal lines perceivable on said object.

10. An infrared reflex device according to claim 9 wherein said pattern is checkered.

11. An infrared reflex device according to claim 8 wherein said panel is elliptical and wherein said partitioning is a series of concentric elliptical boundaries.

* * * * *